US010384225B2

(12) United States Patent
Klink et al.

(10) Patent No.: US 10,384,225 B2
(45) Date of Patent: Aug. 20, 2019

(54) COATING SYSTEM FOR COATING OBJECTS

(71) Applicant: Eisenmann SE, Boeblingen (DE)

(72) Inventors: Felix Klink, Horb (DE); Tobias Mozer, Leinfelden-Echterdingen (DE)

(73) Assignee: EISENMANN SE, Boeblingen (DE)

( * ) Notice: Subject to any disclaimer, the term of this patent is extended or adjusted under 35 U.S.C. 154(b) by 0 days.

(21) Appl. No.: 15/508,172

(22) PCT Filed: Aug. 13, 2015

(86) PCT No.: PCT/EP2015/001666
§ 371 (c)(1),
(2) Date: Mar. 2, 2017

(87) PCT Pub. No.: WO2016/034265
PCT Pub. Date: Mar. 10, 2016

(65) Prior Publication Data

US 2017/0274401 A1 Sep. 28, 2017

(30) Foreign Application Priority Data

Sep. 4, 2014 (DE) ..... 10 2014 012 872

(51) Int. Cl.
*B05B 1/24* (2006.01)
*B05B 5/16* (2006.01)
(Continued)

(52) U.S. Cl.
CPC ..... *B05B 12/1481* (2013.01); *B05B 12/1472* (2013.01); *B05B 15/55* (2018.02);
(Continued)

(58) Field of Classification Search
CPC ..... B05B 1/24; B05B 5/1625; B05B 12/1472; B05B 12/1481; B05B 15/025; B05B 15/55
See application file for complete search history.

(56) References Cited

U.S. PATENT DOCUMENTS

| | | | |
|---|---|---|---|
| 7,549,449 | B2 | 6/2009 | Herre et al. |
| 2009/0277378 | A1 | 11/2009 | Yamauchi |
| 2012/0175432 | A1 | 7/2012 | Milojevic et al. |

FOREIGN PATENT DOCUMENTS

| | | | |
|---|---|---|---|
| DE | 101 60 136 | A1 | 6/2003 |
| DE | 102 23 498 | A1 | 12/2003 |

(Continued)

*Primary Examiner* — Christopher S Kim
(74) *Attorney, Agent, or Firm* — Schroeder Intellectual Property Law Group, LLC

(57) ABSTRACT

A coating system for coating objects having an application device and a supply system which supplies the application device with a liquid material. The supply system includes at least one base supply device with a piggable supply line which extends between a first pigging station and a second pigging station and can be connected to one of multiple material sources by a supply unit. The piggable supply line is a piggable primary supply line which can be connected to a discharge line of the supply unit by a valve unit. A piggable secondary supply line is provided which is connected to the valve unit and is connected to a secondary pigging station at the end remote from the valve unit. The valve unit is designed as a multi-way valve such that the discharge line of the supply unit can be at least selectively connected to the primary supply line (68.1); or the discharge line of the supply unit can be at least selectively connected to the primary supply line and the secondary supply line; or the primary supply line can be at least selectively connected to the secondary supply line.

7 Claims, 8 Drawing Sheets

(51) Int. Cl.
*B05B 12/14* (2006.01)
*B05B 15/55* (2018.01)

(52) U.S. Cl.
CPC ..... *B05B 1/24* (2013.01); *B05B 5/1625* (2013.01); *B05B 12/149* (2013.01)

(56) References Cited

FOREIGN PATENT DOCUMENTS

| | | | |
|---|---|---|---|
| DE | 603 04 386 | T2 | 12/2006 |
| EP | 1 362 642 | A1 | 11/2003 |
| EP | 1 369 183 | A2 | 12/2003 |
| JP | 2002-126608 | A | 5/2002 |
| WO | 03/095106 | A2 | 11/2003 |
| WO | 2010/075322 | A1 | 7/2010 |

COATING SYSTEM FOR COATING OBJECTS

RELATED APPLICATIONS

This application is a national phase of International Patent Application No. PCT/EP2015/001666, filed Aug. 13, 2015, which claims the filing benefit of German Patent Application No. 10 2014 012 872.5, filed Sep. 4, 2014, the contents of both of which are incorporated herein by reference.

FIELD OF THE INVENTION

The invention relates to a coating system having a) an application device;

b) a supply system, by means of which the application device can be supplied with a liquid material;

wherein c) the supply system comprises at least one base supply device with a piggable supply line, which extends between a first pigging station and a second pigging station and can be connected to one of a plurality of material sources by means of a supply unit.

BACKGROUND OF THEN INVENTION

In the present case, "lines" should be taken to mean all flow paths for fluid media. Consequently, these include not only flexible hoses or rigid lines but also channels, flow chambers or even just through openings machined into bodies.

Coating systems of this kind are used to coat objects such as vehicle bodies or body components with the aid of electrostatically operating application devices, for example in the automotive industry. In this context, the coating material, e.g. a paint, is discharged by the application device and subjected to an electric field, in which the coating material discharged is ionized and transferred by virtue of electrostatic forces to the object, which, for this purpose, is at ground potential, for example. An application device of this kind can, for example, be a high-speed rotary atomizer with a rotating bell-shaped plate, from which extremely small paint droplets are thrown, thus forming a paint mist.

In electrostatically operating systems, the lines must build up an insulating section in a direction away from the application device during the coating process, and must be clean and dry to achieve this. In such cases, the lines are manufactured from an electrically insulating material.

In the delivery of paints and other liquid materials through lines, the pigging technique has become established, in which technique a sliding body, referred to as a "pig", pushes a volume of material ahead of it. During this process, the pig is subjected to a pressurized fluid on the side facing away from the delivery volume, it being possible, for example, for said fluid to be compressed air or even a cleaning fluid, which cleans the line behind the pig.

In general, there are "ring lines" as material sources for the coating material, wherein a fluid connection between a ring line carrying material and the piggable supply line can be established by means of the supply unit. Before the pig then forces the material in the direction of the application device, the material is first of all forced into the system by the inherent pressure prevailing in the material sources, i.e. the ring lines.

The line section leading to the application device is quite long and can have a relatively small diameter, e.g. approximately 1 mm, at least in some segments. Owing to this relatively small diameter, there is a pressure loss along the line, making delivery of the material merely by the inherent pressure of the connected material source more difficult. Moreover, the inherent pressure in the material sources is generally not constant but is subject to technically related, irregular fluctuations, which also makes reproducibility of the delivered volume more difficult.

SUMMARY OF THE INVENTION

It is an object of the invention to provide a coating system of the type stated at the outset which takes account of these considerations.

This object may be achieved, in a coating system of the type stated at the outset, in that d) the piggable supply line is a piggable primary supply line, which can be connected to an outlet line of the supply unit by means of a valve unit;

e) there is a piggable secondary supply line, which is connected to the valve unit and is connected to a secondary pigging station at the end remote from the valve unit;

wherein f) the valve unit is designed as a multi-way valve in such a way that, at least optionally, fa) the outlet line of the supply unit can be connected to the primary supply line;

fb) the outlet line of the supply unit can be connected to the primary supply line and the secondary supply line;

or fc) the primary supply line can be connected to the secondary supply line.

With the secondary pig as a delivery element, it is possible, by means of this arrangement according to the invention, for a larger volume of material to be delivered in the direction of the application device by a pig than would be possible without the secondary supply line and without a correspondingly configurable valve unit. For this purpose, the primary and secondary supply lines can first of all be charged from the selected material source by means of the inherent pressure thereof, after which the primary supply line can be connected to the secondary supply line, and the material can be delivered in the direction of the application device by a pig in the secondary supply line. This pig can be subjected to a specified and reproducible delivery pressure, thus ensuring that pressure fluctuations in the material sources then have only a negligible irregularity. Furthermore, a sufficiently high delivery pressure on the material can be built up by means of the pig, and it is therefore also possible to compensate possible pressure losses along the delivery section leading to the application device.

In addition, it is advantageous if the valve unit is designed in such a way that the outlet line of the supply unit can furthermore be connected to the secondary supply line. In this way, it is possible, for example, for a cleaning medium from an appropriate material source to be passed through the supply unit and, from there, directly into the secondary supply line in order to clean the latter independently of other line segments of the system.

The primary supply line is preferably connected via the second pigging station to a pig-free inlet line, which, for its part, is connected to the application device. This pig-free inlet line is preferably used as an insulating section between an electrostatically operating application device and lines carrying material.

It is particularly effective here if the pig-free inlet line is connected at the end remote from the second pigging station to a feed reservoir, from which the application device can be fed.

Particularly uniform supply to the application device is achieved if the feed reservoir is a piston-type metering device.

A compact construction is achieved if the second pigging station of the primary supply line comprises the secondary pigging station of the secondary supply line. Alternatively, however, the secondary pigging station can also be a separate station with dedicated connections and supply lines.

An effective change of material can be accomplished if the application device can be fed via a distributor from a first supply string or a second supply string, which can be connected to the material sources, wherein all further components explained above are present separately in the first supply string and in the second supply string.

It is to be understood that the aspects and objects of the present invention described above may be combinable and that other advantages and aspects of the present invention will become apparent upon reading the following description of the drawings and detailed description of the invention.

BRIEF DESCRIPTION OF THE DRAWINGS

An illustrative embodiment of the invention is explained below with reference to the drawings, in which.

DETAILED DESCRIPTION OF THE PRESENT INVENTION

Figure 1:
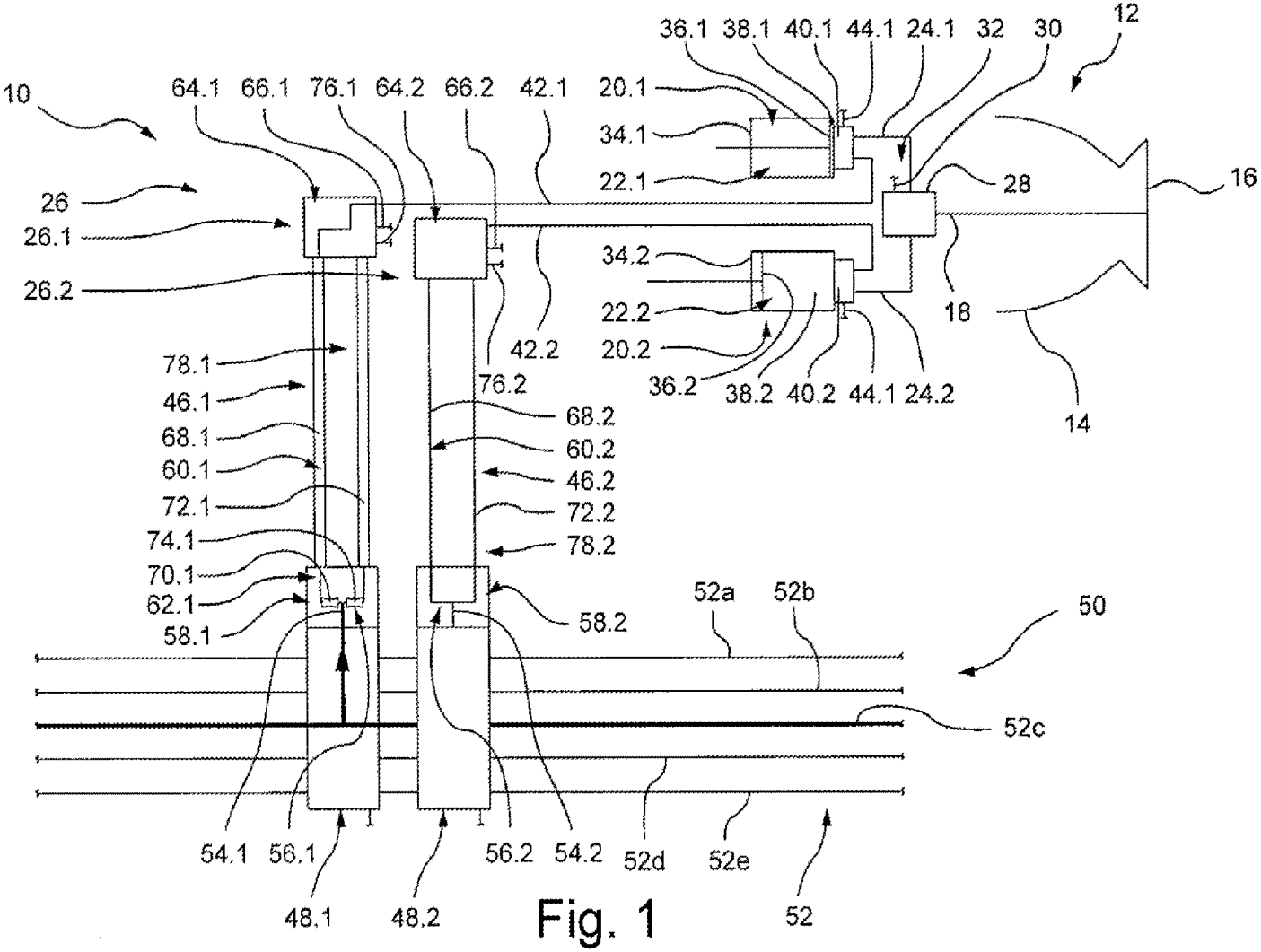
FIG. 1 shows schematically a coating system having an application device and a supply device.

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

The figures show schematically a coating system 10 for coating objects, e.g. vehicle bodies or the parts or attachments thereof.

The coating system 10 comprises an application device 12, which is shown only schematically in the illustrative embodiment under consideration. In the illustrative embodiment under consideration, the application device 12 is an electrostatically operating high-speed rotary atomizer 14 having a rotating bell-shaped plate 16.

The application device 12 comprises a discharge line 18, via which coating material can be discharged onto an object (not shown per se). In the illustrative embodiment under consideration, the discharge line 18 leads to the bell-shaped plate 16 of the high-speed rotary atomizer 14. The bell-shaped plate 16 and the discharge line 18 thus form a discharge device.

The application device 12 can be fed optionally with material from a first feed reservoir 20.1 in the form of a first piston-type metering device 22.1 via a first feed line 24.1 of a first supply string 26.1 or from a second feed reservoir 20.2 in the form of a piston-type metering device 22.2 via a second feed line 24.2 of a second supply string 26.2. The first piston-type metering device 22.1 and the second piston-type metering device 22.2 each illustrate just one example of a first feed reservoir 20.1 and a second feed reservoir 20.2 for coating material.

Together, the two supply strings 26.1, 26.2 form a supply system and have the same construction, for which reason only the first supply string 26.1 will be further explained below for the sake of simplicity. Reference signs for identical parts and components bear the index "0.1" in the first supply string 26.1 and the index "0.2" in the second supply string 26.2. For the sake of clarity, it is furthermore only in FIG. 1 that all the components of the second supply string 26.2 are provided with reference signs. Moreover, pigs shown in the first supply string 26.1 are not shown in the second supply string 26.2; specific reference will be made to this again below.

The two inlet lines 24.1 and 24.2 open at ends remote from the piston-type metering devices 22.1, 22.2 into a distributor 28, which is connected to the discharge line 18, thus allowing the application device 12 to be connected optionally to feed line 24.1 or feed line 24.2.

The distributor 28 is furthermore connected to a cleaning line 30 of a cleaning system 32 (not shown specifically) and is configured in such a way that this cleaning line 30 can be connected optionally to feed line 24.1, feed line 24.2 or the discharge line 18. Via the cleaning line 30, the distributor 28 can be fed in a manner known per se with a cleaning medium, e.g. a solvent, or a pressurized fluid, e.g. compressed air, from associated material sources.

The piston-type metering device 22.1 comprises a cylinder 34.1, in which a piston 36.1 can be moved with the aid of a piston drive (not shown specifically). With the cylinder 34.1, the piston 36.1 delimits a working chamber 38.1, which is connected to the first feed line 24.1 via a valve unit 40.1. Moreover, the working chamber 38.1 is connected via the valve unit 40.1 to an inlet line 42.1 and an outlet line 44.1.

The inlet line 42.1 is pig-free and, for its part, is connected to a piggable base supply device 46.1, by means of which media can be delivered to the inlet line 42.1 using the pigging technique.

As a supply unit, the piggable base supply device 46.1 comprises a "color changing unit" 48.1, which is connected in a manner known per se, via a valve arrangement (not shown specifically) having a ring line 50, to a multiplicity of medium-carrying lines 52, which each define one material source. Of such lines, the figures illustrate just three paint lines 52*a*, 52*b* and 52*c*, a cleaning medium line 52*d* and a compressed air line 52*e*. In practice, it is quite possible for there to be fifty or more medium-carrying lines 52, through which different paints or other media flow.

An outlet line 54.1 of the color changing unit 48.1 is connected via a piggable valve unit 56.1 and a first pigging station 58.1 to a piggable supply line 60.1, in which a pig 62.1 can be moved, as known per se. The first pigging station 58.1 is referred to below as an initial pigging station 58.1. The piggable supply line 60.1 is connected in terms of flow to the application device 12. For this purpose, the piggable supply line 60.1 leads at its end remote from the valve unit 56.1 to a second pigging station 64.1, which is referred to below as the destination pigging station 64.1 and, for its part, connects the piggable supply line 60.1 to the inlet line 42.1.

The destination pigging station 64.1 is furthermore connected in a known manner to a working line 66.1, which can be closed or opened by means of a valve (not shown specifically) and via which a working medium can be fed to the destination pigging station 64.1 and, via this path, to the piggable supply line 60.1, on the one hand, and to the inlet line 42.1, on the other hand, or which can be used as an outlet line in order to discharge medium from the line system.

The pig 62.1 in any case can be moved in both directions between the initial pigging station 56.1 and the destination pigging station 64.1.

As explained at the outset, there are pressure losses in the inlet line 42.1 owing to the small cross section thereof and/or the long length thereof, and therefore it is not always certain that a medium will be delivered satisfactorily into the inlet line 42.1 and the piston-type metering device 22.1 connected thereto by the inherent pressure of the ring line system.

For this reason, the piggable supply line 60.1 is a primary supply line 68.1, and the pig 62.1 is a primary pig 70.1.

Moreover, the piggable base supply unit 46.1 comprises a piggable secondary supply line 72.1, which is connected to the valve unit 56.1 and, at the end remote from the valve unit 56.1, to the destination pigging station 64.1. A secondary pig 74.1 can be moved in the secondary supply line 72.1.

In the piggable second base supply device 46.2 of the second supply string 26.2, there is a corresponding primary pig 70.1 in the piggable primary supply line 68.2 and a corresponding secondary pig 74.1 in the piggable secondary supply line 72.2. However, these pigs are not shown specifically, as already mentioned above.

At its end remote from the initial pigging station 58.1 and the valve unit 56.1 located there, the secondary supply line 72.1 of the base supply unit 46.1 is separated from the application device 12 in terms of flow. In particular, there is no direct connection between the secondary supply line 72.1 and the inlet line 42.1 in the destination pigging station 64.1.

At the destination pigging station 64.1, the secondary supply line 72.1 is connected only to a secondary working line 76.1 located there, which can be closed or opened by means of a valve (not shown specifically). Via the secondary working line 76.1 of the destination pigging station 64.1, it is thus also possible for the piggable secondary supply line 72.1 to be supplied with a working medium or for the secondary working line 76.1 to serve as an outlet line for discharging medium from the secondary supply line 72.1.

In a modification (not shown specifically), it is also possible for there to be just one working line at the destination pigging station 64.1. In this case, the destination pigging station 64.1 is consequently designed as a directional control valve in relation to the inlet line 42.1, the piggable primary supply line 68.1, the piggable secondary supply line 72.1 and the working line, which is then the only working line.

At the initial pigging station 58.1, the piggable secondary supply line 66.1 is connected to the valve unit 56.1. The valve unit 56.1 is designed as a multiway valve in such a way that the outlet line 54.1 of the color changing unit 48.1 can be connected optionally to the primary supply line 68.1 or to the secondary supply line 72.1, or the outlet line 54.1 of the color changing unit 48.1 can be connected to the primary supply line 68.1 and the secondary supply line 72.1, or the primary supply line 68.1 can be connected to the secondary supply line 72.1, while the outlet line 54.1 is shut off.

The secondary supply line 72.1 is used as an auxiliary delivery device 78.1 and the base supply device 46.1 with the primary supply line 68.1 and the secondary supply line 72.1 operates as follows during a color change. Only the sequences that are of interest in this case will be explained below, without entering into detail on supplementary and known processes which are required, for example, for cleaning line segments.

As the initial situation, an operating configuration of the coating system 10 as shown in FIG. 1 will be assumed, in which situation the application device 12 is supplied with paint from the second piston-type metering device 22.2 by moving the piston 36.2 thereof in the direction of the valve unit 40.2. In this case, the valve unit 40.2 shuts off the inlet line 42.2 and the outlet line 44.2 and opens the flow path to the distributor 28. For its part, the distributor connects the feed line 24.2 to the discharge line 18 of the application device 12, which applies the material from the second piston-type metering device 22.2 to an object.

The application device 12 operates electrostatically. For this reason, both inlet lines 42.1 and 42.2 are cleaned and dried, ensuring that an electrical insulating section is formed in each supply string 26.1 and 26.2 between the associated piston-type metering device 22.1 and 22.2 and the base supply device 46.1 and 46.2, respectively, connected thereto. The feed line 24.1 between the distributor 28 and the first piston-type metering device 22.1 is also cleaned and dried, ensuring that an electrical insulating section is likewise formed there.

Moreover, the primary supply line 68.1 and the secondary supply line 72.1 of the first base supply device 46.1 are cleaned and dried; the primary pig 70.1 and the secondary pig 74.1 of the first base supply device 46.1 each assume a parked position in the initial pigging station 58.1, with the result that the outlet line 54.1 of the first color changing unit 48.1 ends at the valve unit 56.1 between the two pigs.

For a color change, the outlet line 54.1 of the first color changing unit 48.1 is then connected to the ring line 52 carrying the paint material which is to be applied next. For example, this may be paint line 52*c*; in FIG. 1, the flow path to the valve unit 56.1 is indicated by a thicker line; the respective flow direction is indicated by an arrow.

Figure 2:
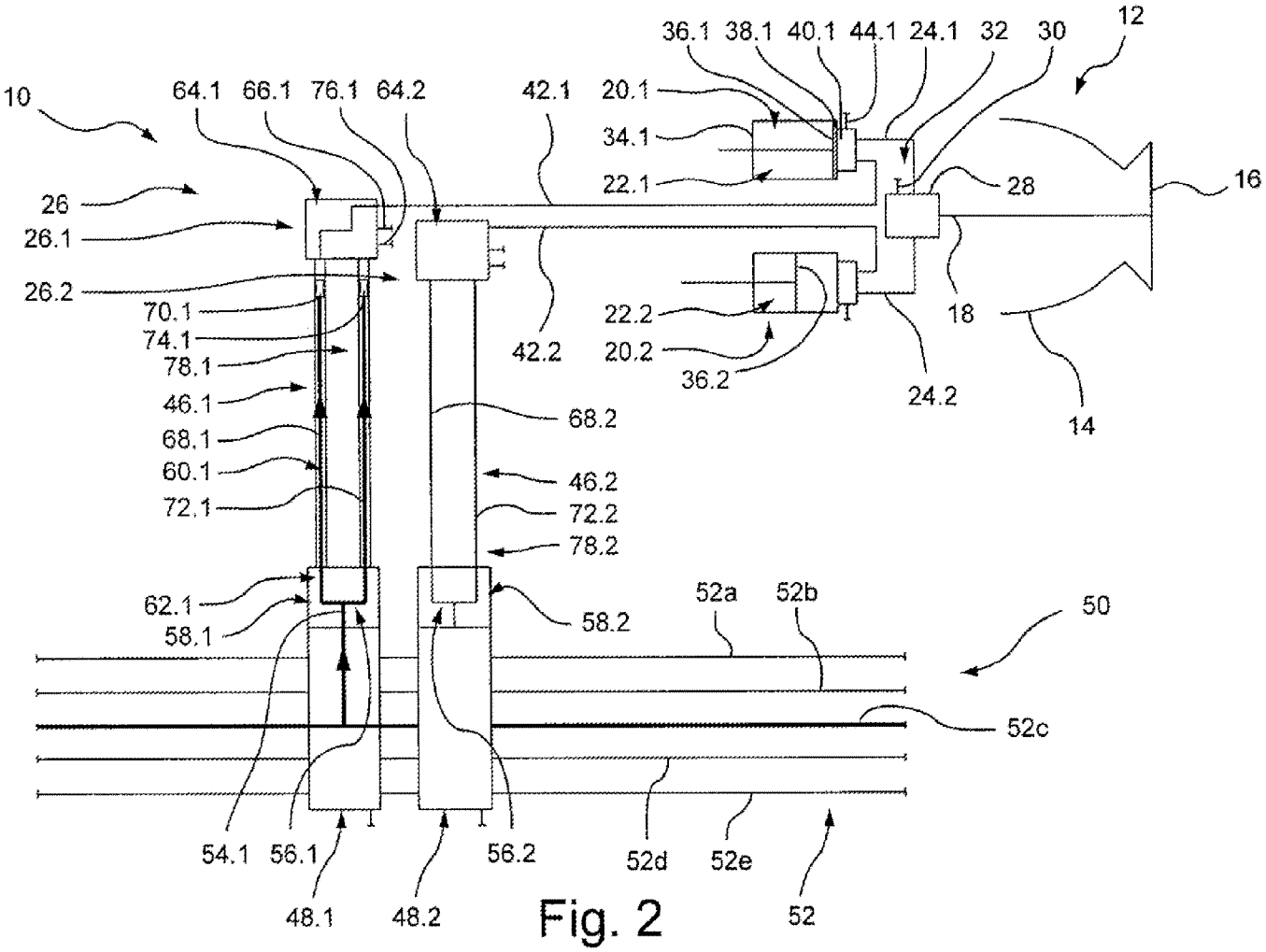
FIGS. 2 to 7 show the coating system of FIG. 1 in different operating phases.

With reference to FIG. 2, the valve unit 56.1 of the first color changing unit 48.1 is then switched to a filling configuration, in which the outlet line 54.1 of the first color changing unit 48.1 is connected both to the primary supply line 68.1 and to the secondary supply line 72.1. Owing to the inherent pressure prevailing in the ring line 52*c*, paint then flows both into the primary supply line 68.1 and into the secondary supply line 72.1, wherein the paint material pushes the primary pig 70.1 and the secondary pig 74.1 ahead of it until these have each reached a filling position in their respective supply lines 72.1 and 72.2.

Figure 3:
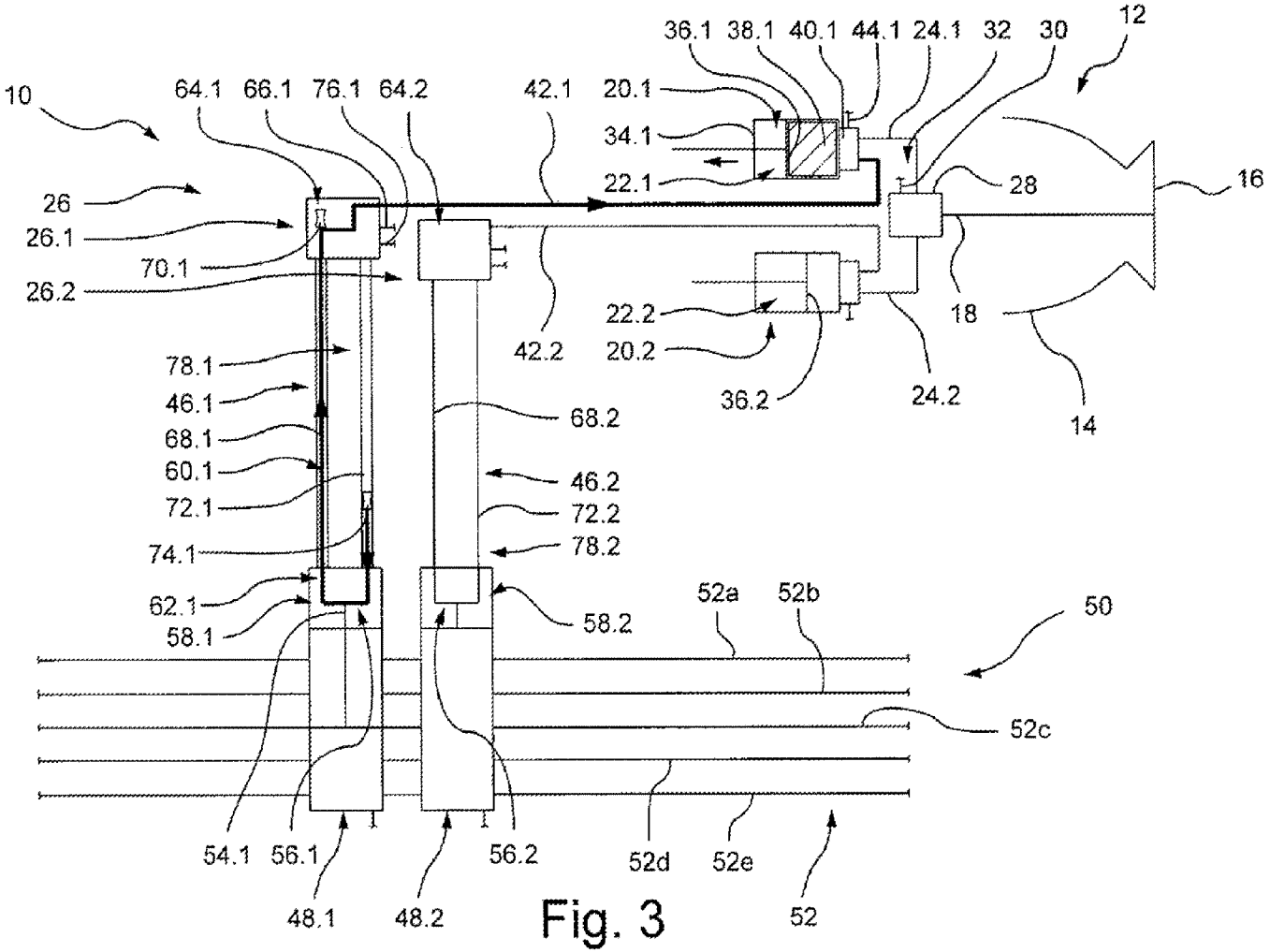

The valve unit 56.1, as shown in FIG. 3, is then switched to a delivery configuration, in which the primary supply line 68.1 is connected to the secondary supply line 72.1. The secondary pig 74.1 is then subjected, on its side facing away from the paint material, to a pressurized fluid, in particular compressed air or a cleaning medium, via the secondary working line 76.1 at the destination pigging station 64.1, as a result of which the secondary pig 74.1 is forced against the paint material in the secondary supply line 72.1. As a result, the paint material in the primary supply line 68.1 and the secondary supply line 72.1 is delivered through the destination pigging station 64.1 into the inlet line 42.1 and, via this route, into the piston-type metering device 22.1, the piston 36.1 of which correspondingly moves away from the valve unit 40.1. This is indicated by an arrow.

By means of the secondary pig 74.1, the paint material can be delivered to the piston-type metering device 22.1 that has a reproducible and, in particular, uniform pressure without the occurrence of pressure fluctuations of the kind which occur when the inherent pressure in the ring line system 50 is used to deliver a paint material to one of the piston-type metering devices 22.1, 22.2. In this way, it is thus also possible to counteract in an effective way the pressure loss along the delivery section caused by the smaller cross section in the inlet lines 42.1, 42.2.

Figure 4:
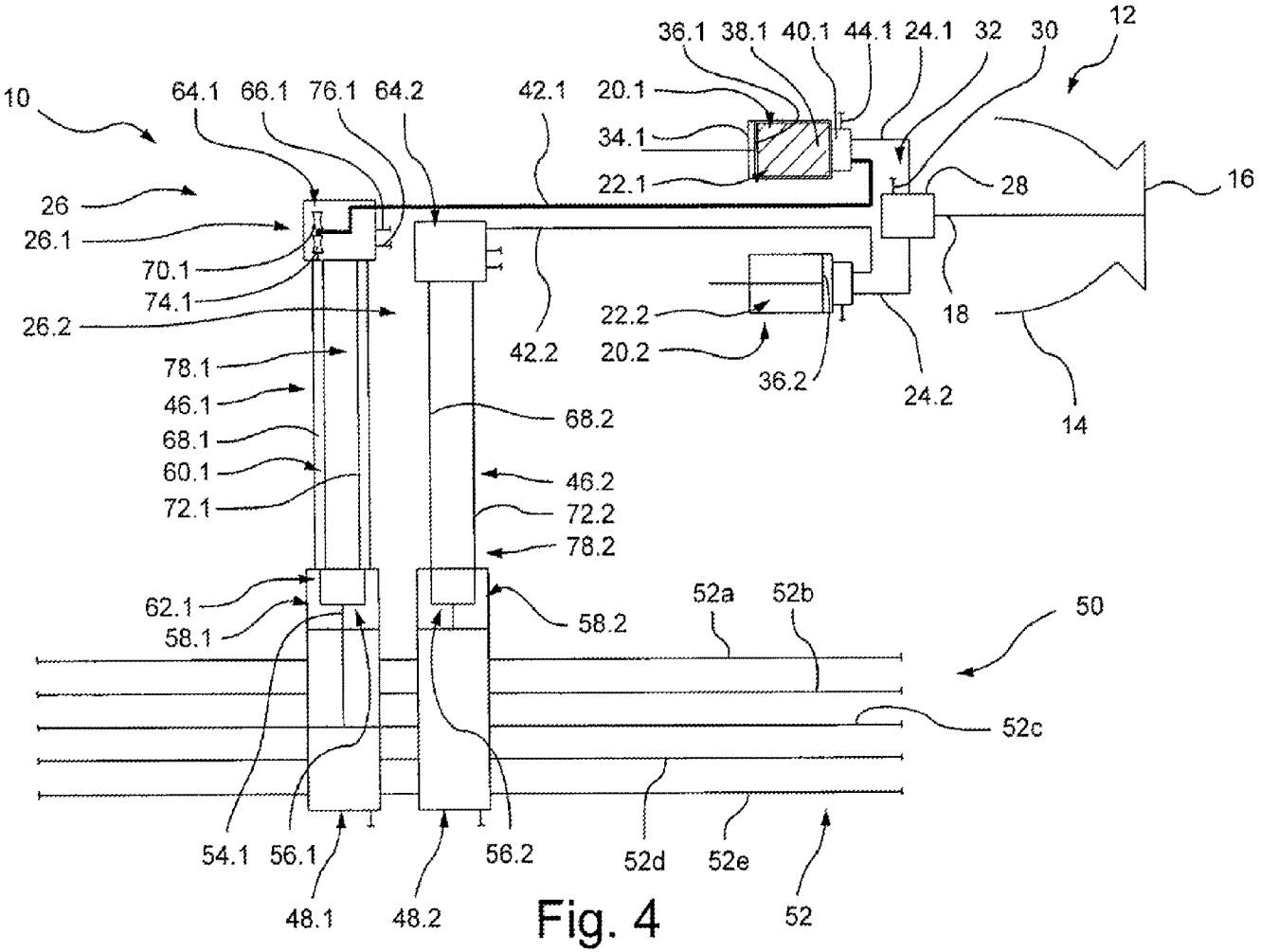

The secondary pig 74.1 is forced through the piggable valve unit 56.1 of the initial pigging station 58.1 into the primary supply line 68.1, as a result of which the paint material is forced onward through the primary supply line 68.1, the destination pigging station 64.1 and the inlet line 42.1 into the piston-type type metering device 22.1, until the latter has been filled with the desired quantity of paint material. This operating state is shown by FIG. 4; there, the secondary pig 74.1 has reached a delivery end position in which it abuts the primary pig 70.1 and the inlet line 42.1 is filled with paint material.

Before the electrostatic application process is then initiated and the application device 12 can be set to high voltage potential, the application device 12 must first of all be freed from the material from the second piston-type metering device 22.2 and cleaned and, at the same time, the inlet line 42.1 must be freed from conductive material and dried, thus ensuring that an electrical insulating section is built up between the destination pigging station 64.1 and the first piston-type metering device 22.1. For this purpose, first a cleaning fluid and then compressed air are forced into the line system via the cleaning line 30 on the distributor 28.

Via the feed line 24.1, the cleaning fluid reaches the valve unit 40.1 on the first piston-type metering device 22.1 and, via this route, enters the inlet line 42. The paint material still present in the inlet line 42.1 is initially forced between the two pigs 70.1 and 74.1 at the destination pigging station 64.1 by the cleaning fluid, with the result that the secondary pig 74.1 can discharge the pressurized fluid present in the primary supply line 68.1 and the secondary supply line 72.1 out of the system through the secondary working line 76.1 on the destination pigging station 64.1. For this purpose, the valve unit 56.1 of the first color changing unit 48.1 is first of all switched to a cleaning configuration in such a way that the primary supply line 68.1 is connected to the secondary supply line 72.1 and the outlet line 54.1 of the first color changing unit 48.1 is shut off. The cleaning configuration thus corresponds to the delivery configuration.

Figure 5:
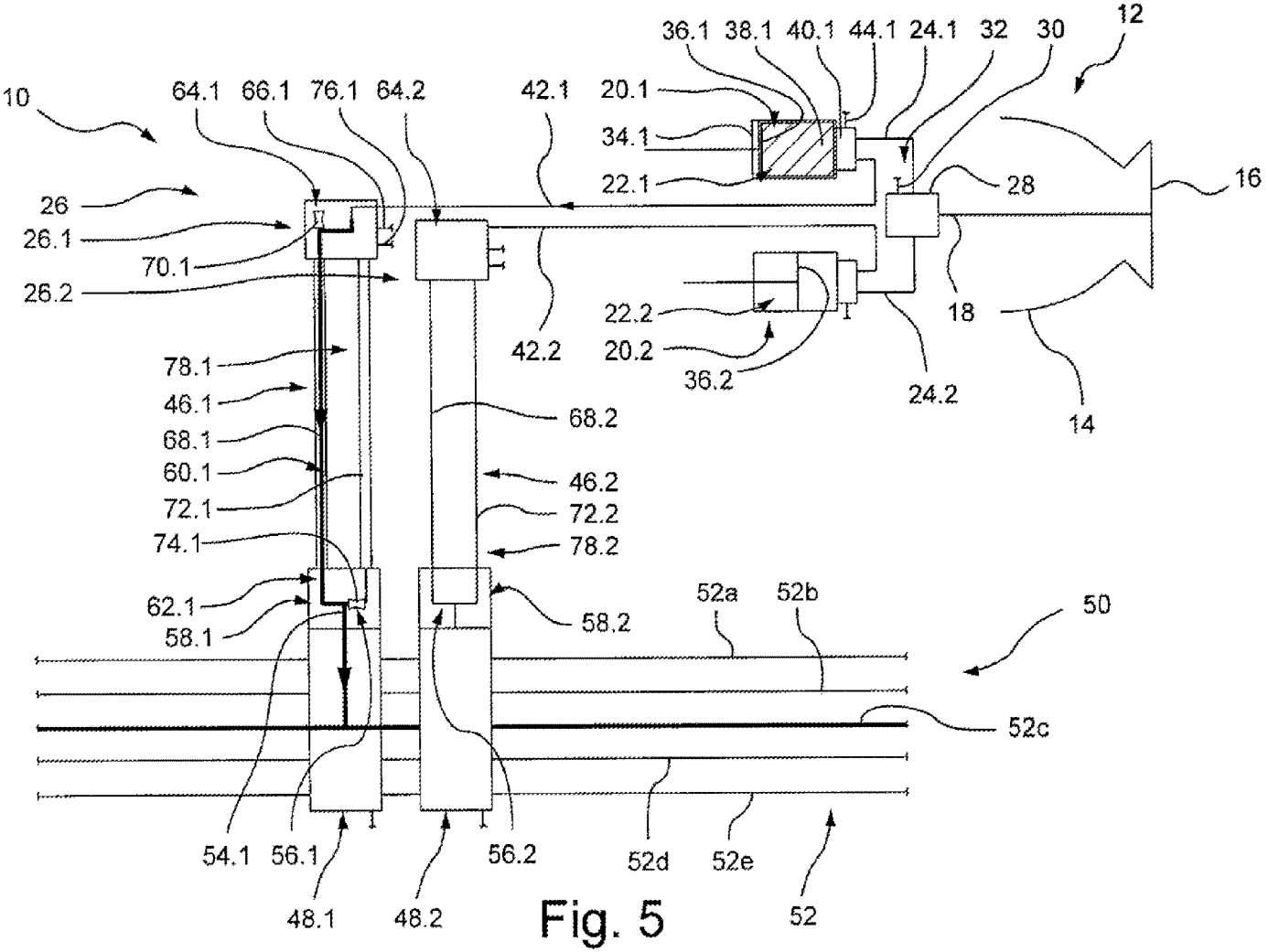

If, as illustrated by FIG. 5, the secondary pig 74.1 then assumes its parked position in the initial pigging station 58.1, the valve unit 56.1 can be switched to a return configuration, in which the primary supply line 68.1 is connected to the outlet line 54.1 and the secondary supply line 72.1 is shut off. Paint material is then forced through the primary supply line 68.1 and back into the ring line 52*c*. If the phase boundary between the cleaning fluid and the paint material moves from the inlet line 42.1 to the destination pigging station 64.1, as FIG. 5 likewise shows, the primary pig 70.1 is transferred back into the primary supply line 68.1 in the direction of the initial pigging station 58.1, with the result that it separates the phase boundary from reusable paint material.

Figure 6:
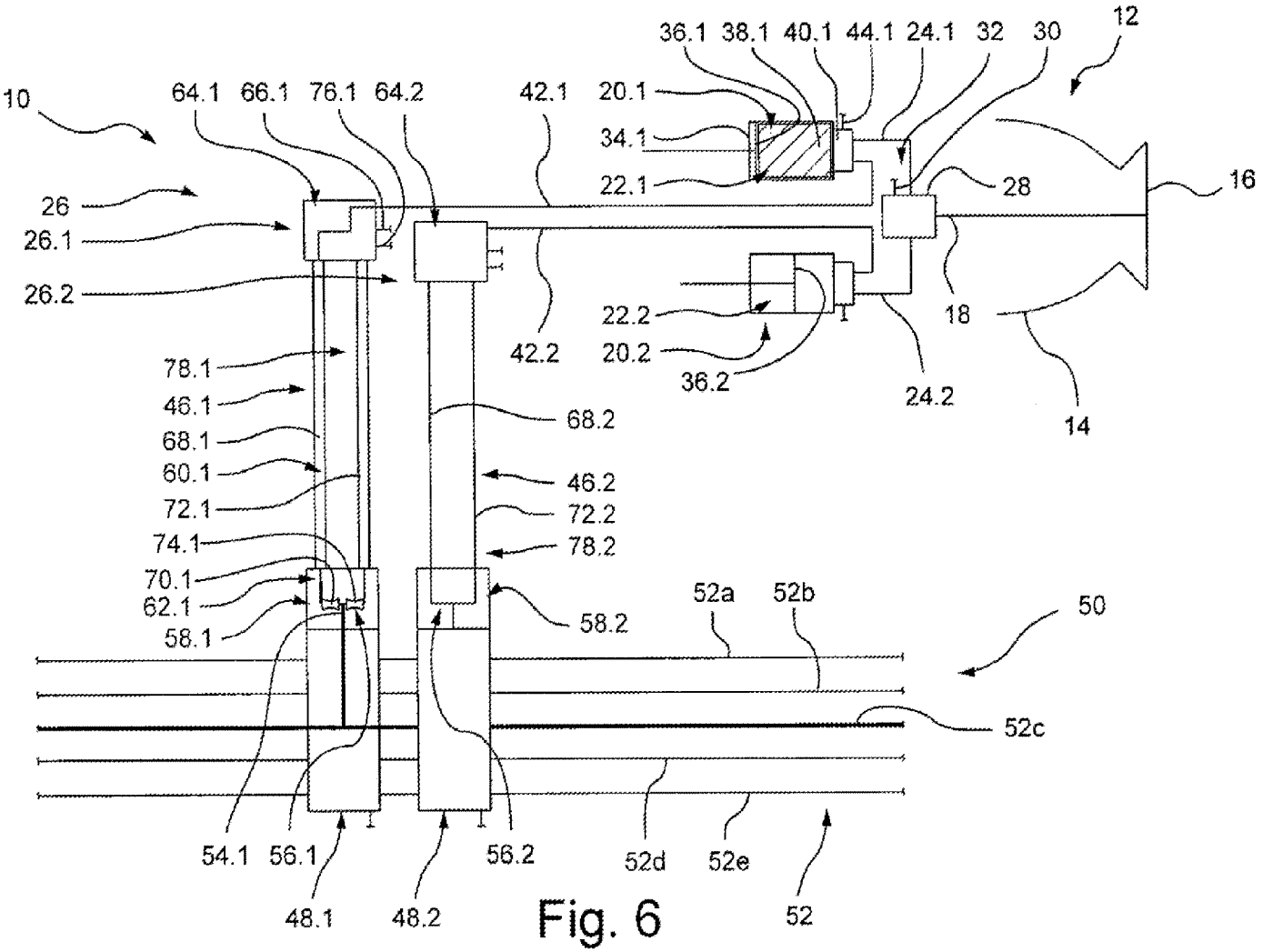

As FIG. 6 shows, the primary pig 70.1 finally also reaches its parked position in the initial pigging station 58.1 again, wherein there is still a paint residue, cleaning fluid and compressed air behind the primary pig 70.1. The valve unit 56.1 is then switched back into the cleaning configuration, in which the primary supply line 68.1 is connected to the secondary supply line 72.1, and the outlet line 54.1 of the first color changing unit 48.1 is shut off. The compressed air then forces this paint residue and the cleaning fluid out of the opened secondary working line 76.1 at the destination pigging station 64.1 and out of the system, wherein the lines which have then been cleaned are dried by the compressed air.

Figure 7:
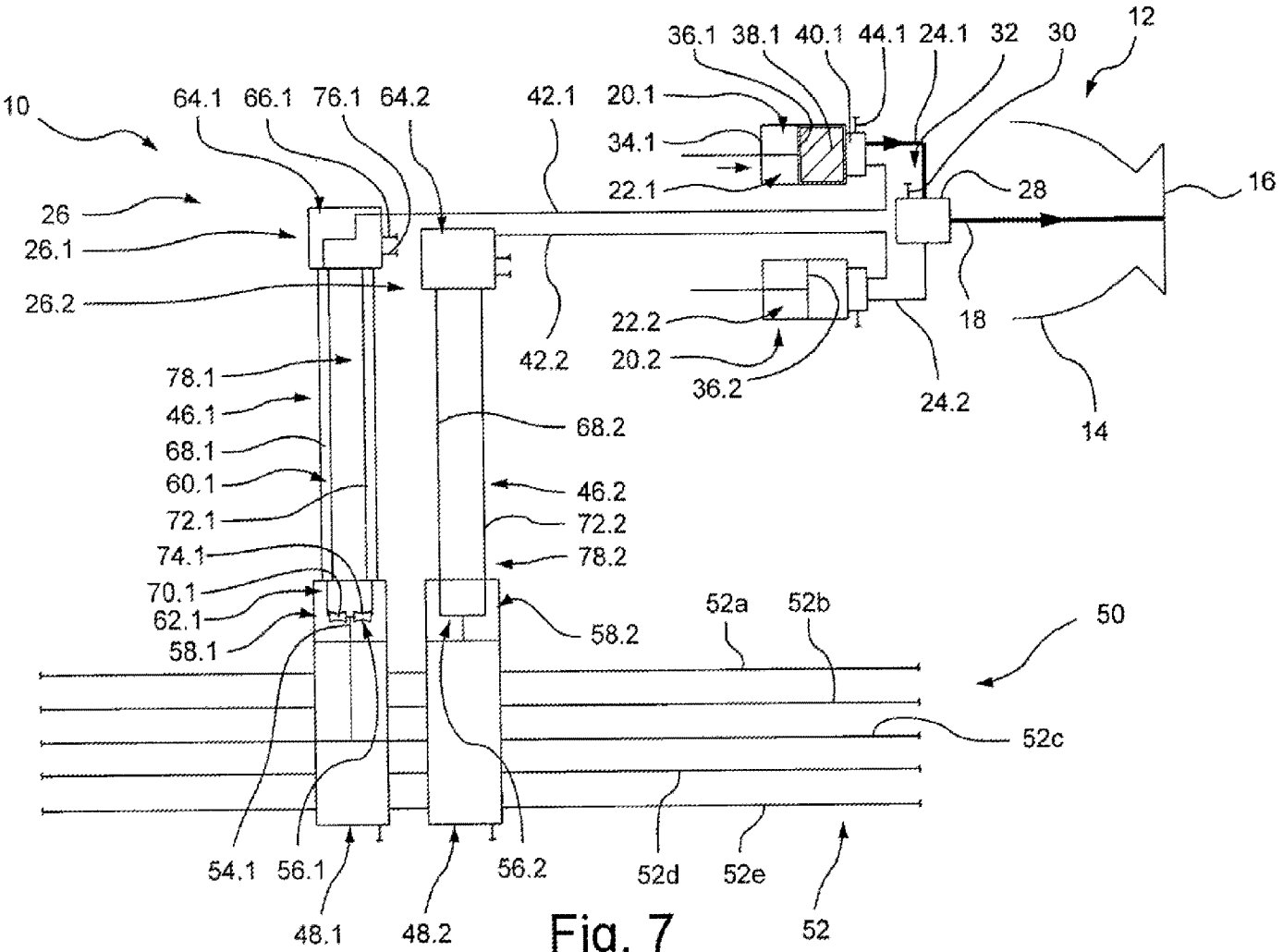

The first supply string 26.1 is then ready for the application of the paint material from the piston-type metering device 22.1, for which purpose the valve unit 40.1 shuts off the inlet line 42.1 and connects the piston-type metering device 22.1 to the distributor 28, which opens the flow path to the discharge line 18. The piston 36.1 is moved in the direction of the valve unit 40.1, this once again being indicated by an arrow, and the application of the paint material is carried out, as illustrated by FIG. 7.

During this application process, the second piston-type metering device 22.2 of the second supply string 26.2 can then be filled with material in the manner explained above.

If appropriate, the primary supply line 68.1 and the secondary supply line 72.1 can continue to be supplied with cleaning fluid and compressed air via the working line 66.1 at the destination pigging station 64.1 during application in order to perform any further cleaning of these lines.

Figure 8:
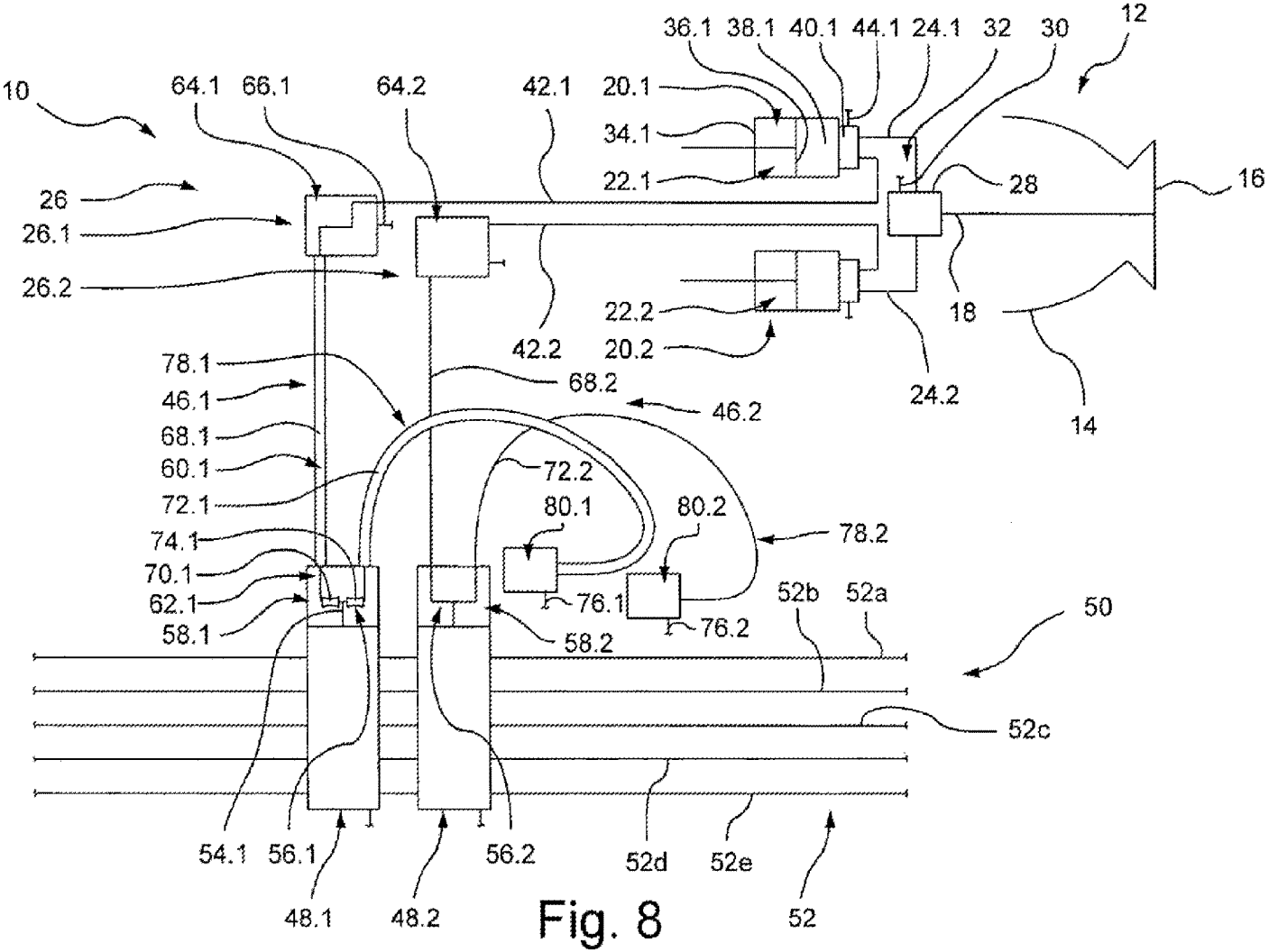
FIG. 8 shows a modified coating system.

FIG. 8 shows a modification of the coating system 10, in which the secondary supply lines 72.1 and 72.2 are not connected to the respective destination pigging stations 64.1 and 64.2, respectively, of the two supply strings 26.1 and 26.2 but are each connected to a dedicated secondary pigging station 80.1, 80.2, which has the secondary working line 76.1, 76.2.

In this coating system, however, the sequences take place in the same way as explained above with reference to FIGS. 1 to 7. In the illustrative embodiment according to FIGS. 1 to 7, the destination pigging stations 64.1, 64.2 thus comprise the respective secondary pigging stations 80.1, 80.2.

It is to be understood that additional embodiments of the present invention described herein may be contemplated by one of ordinary skill in the art and that the scope of the present invention is not limited to the embodiments disclosed. While specific embodiments of the present invention have been illustrated and described, numerous modifications come to mind without significantly departing from the spirit of the invention, and the scope of protection is only limited by the scope of the accompanying claims.

We claim:

1. A coating system for coating objects comprising:

a) an application device;

b) a supply system which supplies the application device with a liquid material;

wherein c) the supply system comprises at least one base supply device with a supply line having at least a first sliding body which traverses back and forth, the supply line extending between a station for parking at least the first sliding body and a second station for parking at least the first sliding body and can be connected to one of a plurality of material sources by a supply unit, wherein d) the supply line is a primary supply line, which can be connected to an outlet line of the supply unit by a valve unit;

e) there is a secondary supply line having at least a second sliding body which traverses back and forth, which is connected to the valve unit and is connected to a secondary station which connects the secondary supply line to a secondary working line at an end remote from the valve unit;

wherein f) the valve unit is designed as a multi-way valve in such a way that the valve unit can selectively connect, fa) the outlet line of the supply unit to the primary supply line;

fb) the outlet line of the supply unit to the primary supply line and the secondary supply line;

or fc) the primary supply line to the secondary supply line.

2. The coating system as claimed in claim 1, wherein the valve unit is designed in such a way that the outlet line of the supply unit can furthermore be connected to the secondary supply line.

3. The coating system as claimed in claim 1, wherein the primary supply line is connected via the second station for parking at least the first sliding body to an inlet line, which, for its part, is connected to the application device.

4. The coating system as claimed in claim 3, wherein the inlet line is connected at an end remote from the second station for parking at least the first sliding body to a feed reservoir, from which the application device can be fed.

5. The coating system as claimed in claim 4, wherein the feed reservoir is a piston-type metering device which comprises a cylinder in which a piston can be moved.

6. The coating system as claimed in claim 1, wherein the second station of the primary supply line comprises the secondary station of the secondary supply line.

7. The coating system as claimed in claim 1, wherein the application device can be fed via a distributor from a first supply string or a second supply string, which can be connected to the material sources, wherein all further components claimed in claim 1 are present separately in the first supply string and in the second supply string.

* * * * *